US009803393B2

(12) United States Patent
Chow

(10) Patent No.: US 9,803,393 B2
(45) Date of Patent: Oct. 31, 2017

(54) ELECTRICAL MECHANICAL LOCKING DEVICE

(71) Applicant: Leslie Ho Leung Chow, Shilouzhen Panyu District (CN)

(72) Inventor: Leslie Ho Leung Chow, Shilouzhen Panyu District (CN)

( * ) Notice: Subject to any disclaimer, the term of this patent is extended or adjusted under 35 U.S.C. 154(b) by 0 days.

(21) Appl. No.: 14/667,218

(22) Filed: Mar. 24, 2015

(65) Prior Publication Data

US 2016/0281389 A1 Sep. 29, 2016

(51) Int. Cl.
*E05B 47/06* (2006.01)
*E05B 49/00* (2006.01)
(Continued)

(52) U.S. Cl.
CPC ..... *E05B 47/0611* (2013.01); *E05B 47/0009* (2013.01); *E05B 47/063* (2013.01);
(Continued)

(58) Field of Classification Search
CPC .... E05B 51/005; E05B 47/00; E05B 47/0009; E05B 47/0011; E05B 47/06;
(Continued)

(56) References Cited

U.S. PATENT DOCUMENTS 4,301,668 A * 11/1981 Renz ..... E05B 17/0062 70/422
4,961,328 A * 10/1990 Mundhenke ..... E05B 9/10 70/1.5
(Continued)

*Primary Examiner* — Christopher J Boswell
*Assistant Examiner* — Amanda L Bailey
(74) *Attorney, Agent, or Firm* — John R. Ross, III; John R. Ross

(57) ABSTRACT

An electrical mechanical locking device. A lock has an outer shell with an indentation. An inner body is rotatably housed within the outer shell. A contact pin is connected to the inner body. A printed circuit board frame is rigidly connected to the inner body. A printed circuit board is attached to the printed circuit board frame. A driver arm support bracket is rigidly connected to the printed circuit board frame. A lock microprocessor is connected to the printed circuit board and electrically connected to the contact pin. The lock microprocessor is connected to a key identification code verification database. An electrical actuator is electrically connected to the lock microprocessor. A driver arm is pivotally connected to the driver arm support bracket. The electrical actuator is connected to the driver arm. A jam plate is connected to the driver arm. A jam plate return spring is connected to the jam plate and the printed circuit board frame. A locking pin is covered by the jam plate and inserted into the outer shell indentation when the electrical mechanical device is locked. When the electrical mechanical device is unlocked the locking pin is not covered by the jam plate and rises clear of the indentation. A powered key includes a key microprocessor. A battery power source is electrically connected to the key microprocessor. The key microprocessor has access to key database that includes a programmable key identification code for identifying the key. The key also includes a contact tip for insertion into the lock and for making electrical contact with the lock contact pin. In a preferred embodiment the electrical actuator is a nitinol wire.

7 Claims, 9 Drawing Sheets

(51) Int. Cl.
*E05B 51/00* (2006.01)
*E05B 47/00* (2006.01)
*G07C 9/00* (2006.01)

(52) U.S. Cl.
CPC ..... *E05B 49/002* (2013.01); *E05B 51/005* (2013.01); *G07C 9/00706* (2013.01); *E05B 47/0001* (2013.01); *E05B 2047/0048* (2013.01); *E05B 2047/0058* (2013.01); *E05B 2047/0072* (2013.01); *E05B 2047/0083* (2013.01)

(58) Field of Classification Search
CPC ..... E05B 47/0603; E05B 47/0001; E05B 47/0611; E05B 2047/0036; E05B 2047/0037; E05B 2047/0048; E05B 2047/0072; E05B 2047/0073; E05B 2047/0083; E05B 2047/0084; E05B 49/00; E05B 49/002; E05B 49/004; E05B 47/063; E05B 2047/0058; G07C 9/00706
See application file for complete search history.

(56) References Cited

U.S. PATENT DOCUMENTS 5,351,042 A * 9/1994 Aston ..... E05B 47/063 340/5.61
7,406,846 B2 * 8/2008 Chu ..... E05B 47/0009 70/278.1
7,690,231 B1 * 4/2010 Field ..... E05B 47/0009 292/DIG. 66
2005/0252260 A1 * 11/2005 Chu ..... E05B 47/0009 70/278.7
2006/0172557 A1 * 8/2006 He ..... E05B 47/0009 439/34

* cited by examiner 1
2
11
12
12d
20
21
23
24
25
26
27
29
35
38
43
44
46
48
49
51
89

ELECTRICAL MECHANICAL LOCKING DEVICE

The present invention relates to locking devices, and in particular, to electrical mechanical locking devices.

BACKGROUND OF THE INVENTION

Prior Art Electromechanical Locking Devices

Electromechanical locking devices are known and include electrically interfaced or controlled release mechanisms for operating a lock cylinder. For example, U.S. Pat. No. 4,712,398 discloses an electronic locking system comprising a lock cylinder with a rotatable plug located therein. An electronically activated release assembly is provided which selectively disengages a locking pin from the plug to allow turning of the key to rotate the plug relative to the cylinder. The lock cylinder and key each include an electronic memory device containing keying system codes. Upon insertion of the key the release mechanism disengages the locking pin from the plug to allow its rotation. U.S. Pat. No. 5,552,777 discloses another type of electromechanical cylinder lock having a blocking pin and an electromagnetic solenoid in the cylinder plug. The blocking pin extends into a recess in the cylinder shell, and is retracted upon actuation of the solenoid by a microprocessor in the key.

One benefit of including electronic control features in locks is that an electronic record can be kept of lock usage. Also, electronic control features in locks provides for the ability to have increased keying codes for operating the lock. For example, information can be stored in the lock and/or key such that the locking mechanism is activated in response to detecting and/or exchanging data. As the information stored in the components may be altered, it is possible to vary the keying codes without changing the system hardware. In contrast, changing the mechanical keying codes in a purely mechanical lock typically requires forming a new key with different bitting surfaces, a more involved process than reprogramming electronic components of an electromechanical lock.

Nitinol Wire

Nitinol Wire (also known as 'Muscle Wire' or 'Memory Wire') is a thin strand of a special shape memory alloy composed primarily of Nickel (Ni) and Titanium (Ti). Nitinol Wire will shorten in length after receiving an electrical signal, or heated by other means. Nitinol wire returns to its original length the electrical signal is removed and/or cooled.

What is needed is an improved electrical mechanical locking device.

SUMMARY OF THE INVENTION

The present invention provides an electrical mechanical locking device. A lock has an outer shell with an indentation. An inner body is rotatably housed within the outer shell. A contact pin is connected to the inner body. A printed circuit board frame is rigidly connected to the inner body. A printed circuit board is attached to the printed circuit board frame. A driver arm support bracket is rigidly connected to the printed circuit board frame. A lock microprocessor is connected to the printed circuit board and electrically connected to the contact pin. The lock microprocessor is connected to a key identification code verification database. An electrical actuator is electrically connected to the lock microprocessor. A driver arm is pivotally connected to the driver arm support bracket. The electrical actuator is connected to the driver arm. A jam plate is connected to the driver arm. A jam plate return spring is connected to the jam plate and the printed circuit board frame. A locking pin is covered by the jam plate and inserted into the outer shell indentation when the electrical mechanical device is locked. When the electrical mechanical device is unlocked the locking pin is not covered by the jam plate and rises clear of the indentation. A powered key includes a key microprocessor. A battery power source is electrically connected to the key microprocessor. The key microprocessor has access to key database that includes a programmable key identification code for identifying the key. The key also includes a contact tip for insertion into the lock and for making electrical contact with the lock contact pin. In a preferred embodiment the electrical actuator is a nitinol wire.

DETAILED DESCRIPTION OF THE PREFERRED EMBODIMENTS

Figures 1A, 1B, 1C, 1D, 1E, 1F, 1G:
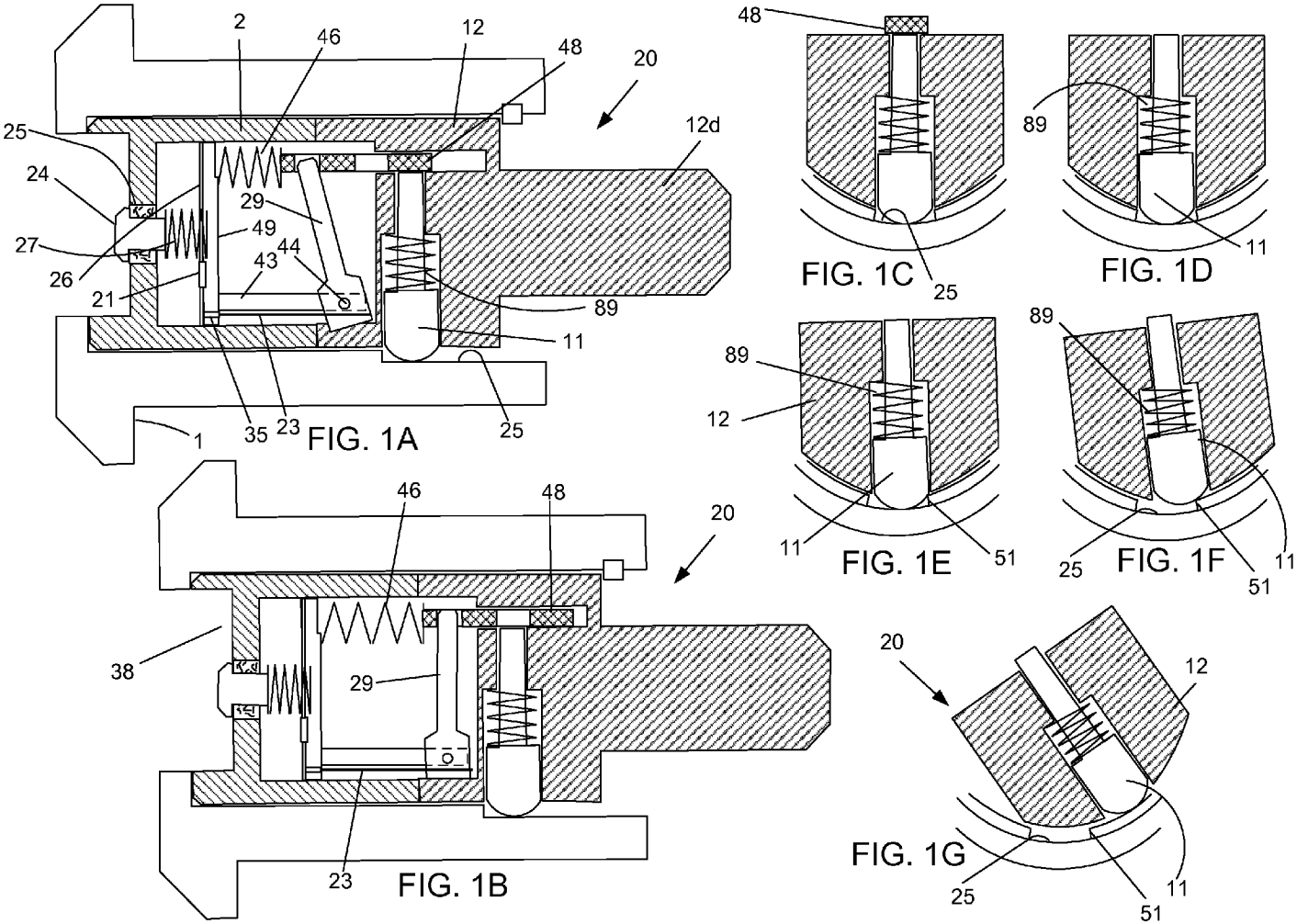
FIGS. 1A-1G show a preferred embodiment of the present invention.
Figure 2:
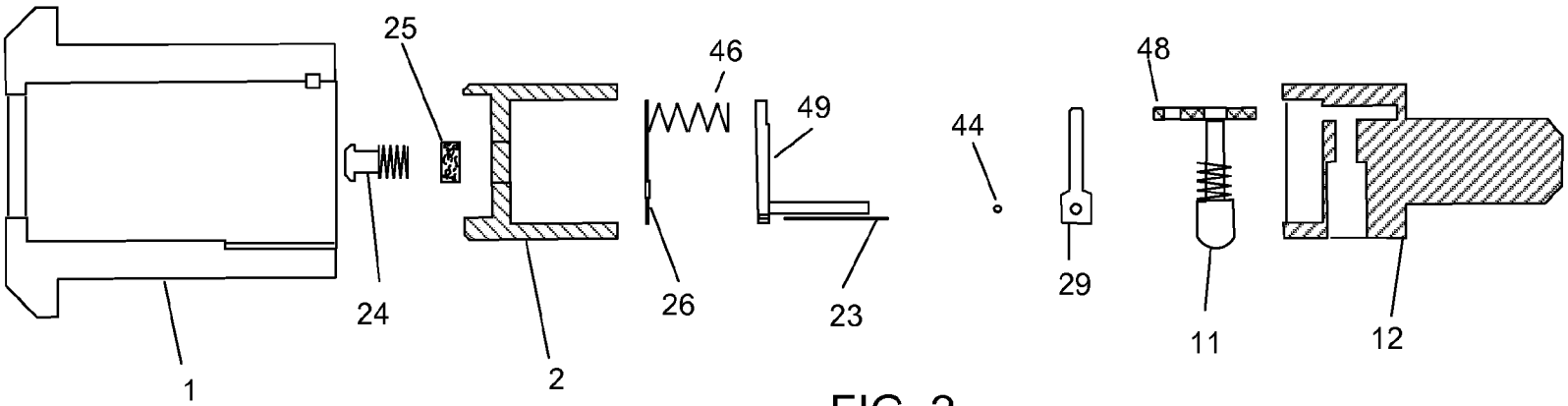
FIG. 2 shows an exploded view of a preferred lock.

FIG. 1A shows a side view of a preferred lock 20 in a locked position and FIG. 2 shows an exploded view of a preferred lock 20. In FIG. 1A, inner body 2 is rigidly engaged with lower inner body 12. Inner body 2 and lower inner body 12 are rotatably housed within outer shell 1. Outer shell 1 is preferably rigidly attached to the object being locked, such as a safe door. In a preferred embodiment, lower inner body 12 includes extension 12*d* which preferably engages a latch (not shown). As a key is turned and lower inner body 12 is rotated, the latch will slide free to open the door.

Figure 4B:
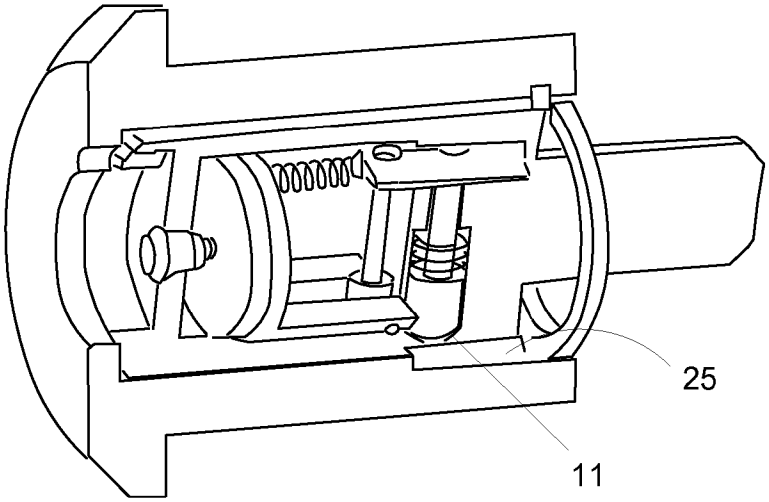
FIGS. 4A and 4B show a perspective view of a preferred embodiment of the present invention.
Figure 4A:
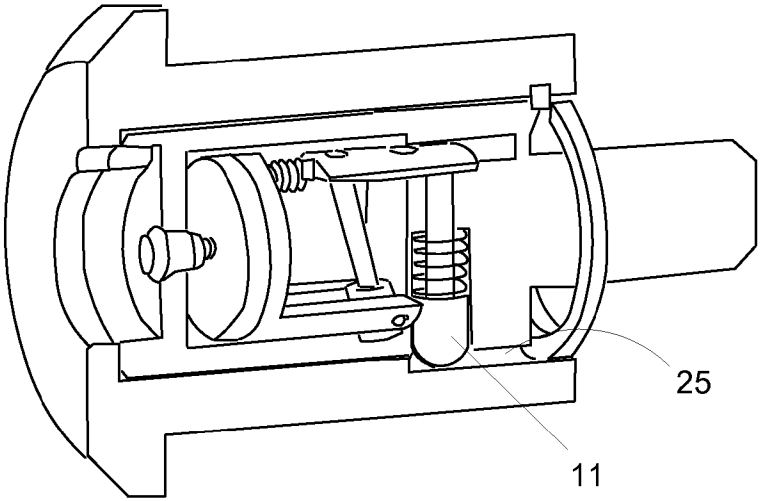

In the locked position, locking pin 11 is inserted into indentation 25 (FIG. 1A, FIG. 4A) cut into outer shell 1, which prevents the rotation of inner body 2 and lower inner body 12. Inner body 2 and lower inner body 12 cannot be rotated until locking pin 11 is raised clear of indentation 25.

Figure 5A:
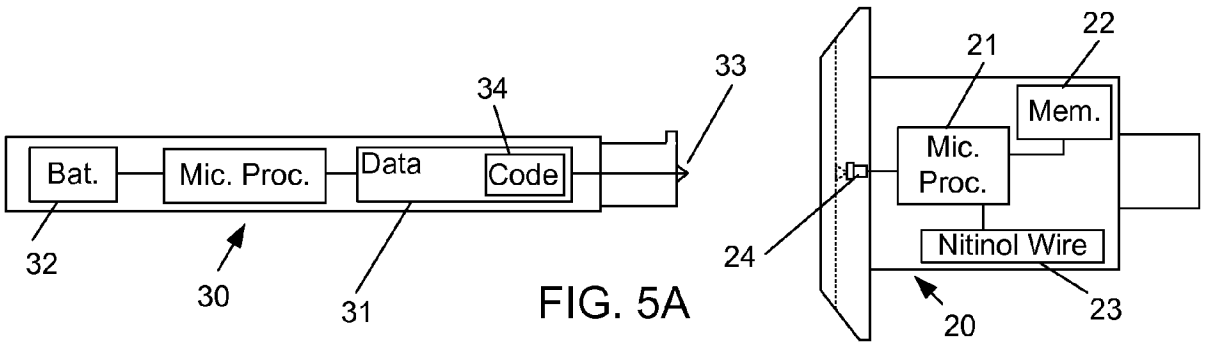
FIGS. 5A and 5B show a preferred key and a preferred lock.
Figure 5B:
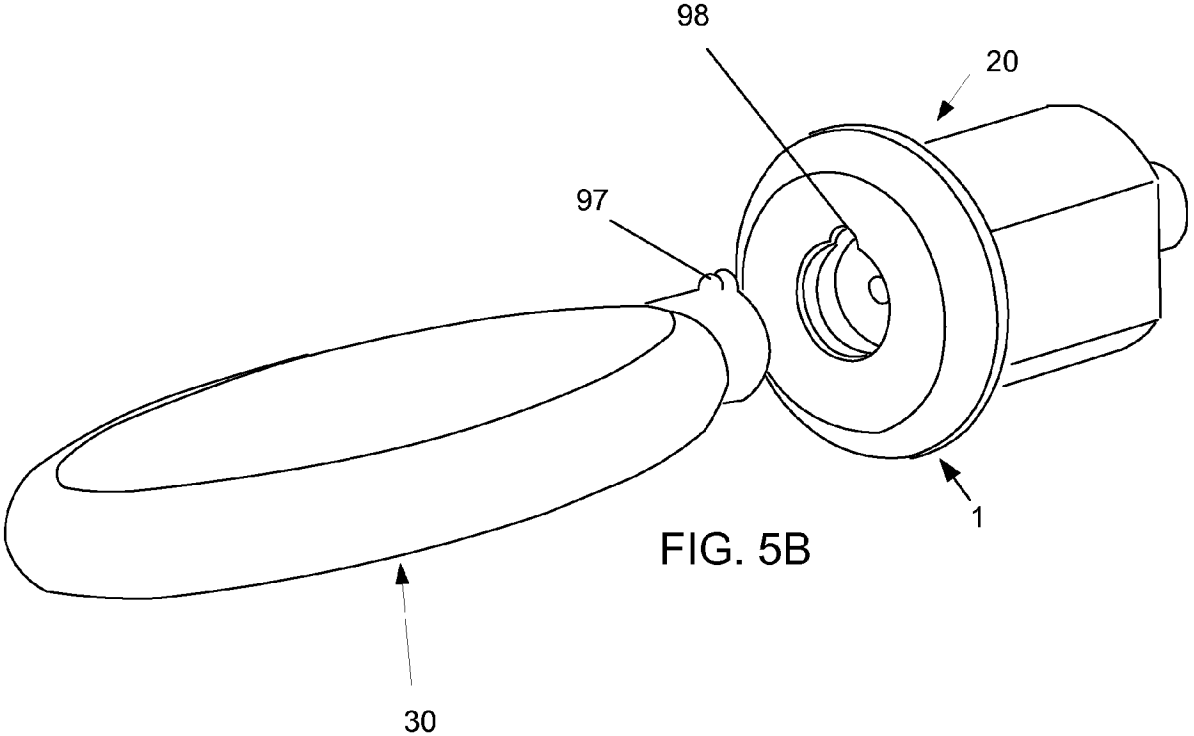

To unlock lock 20 the user inserts key 30 into lock 20 as shown in FIGS. 5A and 5B. A key specific ID code 34 identifying key 30 is stored in database 31. Key 30 is powered by battery 32. Microprocessor 30 includes programming to transfer the key's ID code 34 through contact tip 33 to lock 20 when key 30 is inserted into the lock. Lock 20 includes contact pin 24, microprocessor 21, memory 22 and nitinol wire 23. Microprocessor 21 includes programming to receive ID code 34 and compare it against a list of acceptable codes stored in memory 22. If ID code 34 does not match an acceptable code, then microprocessor 21 will not transfer power to nitinol wire 23 and lock 20 will remain locked. However, if ID code 34 is verified, then microprocessor will allow power to be transmitted to nitinol wire 23. The user will then be able to turn the key and open the lock.

As key 30 is inserted into lock 20, contact tip 33 makes contact with contact pin 24. Contact pin 24 is surrounded and insulated by insulator 25 (FIG. 1A). An electrical signal is transmitted from contact tip 33 through contact pin 24 and then through contact spring 27 to printed circuit board (PCB) 26. PCB 26 is mounted onto PCB frame 49. Microprocessor 21 is mounted on PCB 26 and receives the electrical signal. As stated above, if ID code 34 does not match an acceptable code, then microprocessor 21 will not transfer power to nitinol wire 23 and lock 20 will remain locked. However, if ID code 34 is verified, then microprocessor will allow power to be transmitted to nitinol wire 23.

Nitinol Wire Contraction

Figure 6B:
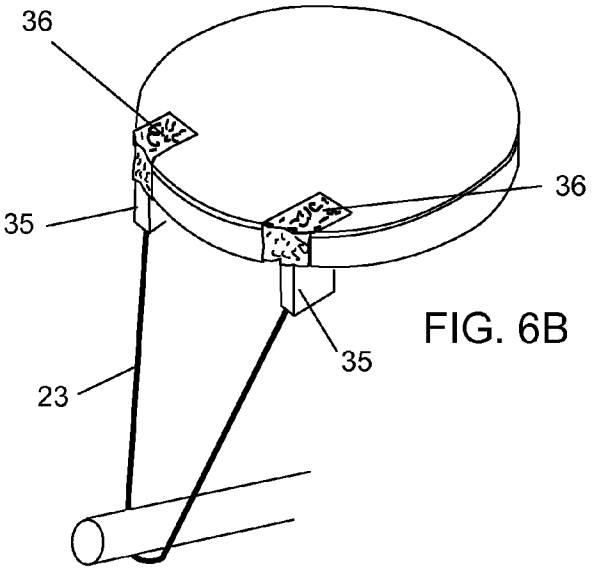
FIGS. 6A and 6B show the mounting of a preferred nitinol wire.
Figure 6A:
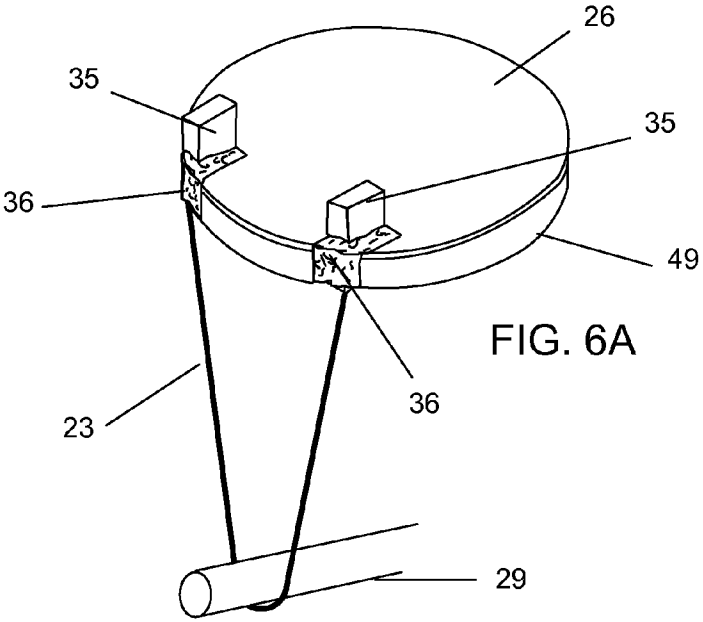

Power is transmitted to nitinol wire 23 from microprocessor 21 (FIG. 1A) through electronic connections on PCB 26. In a preferred embodiment nitinol wire 23 is looped around driver arm 29 and connected to PCB 26 via nitinol wire crimps 35. In a preferred embodiment, crimps 35 are soldered to PCB 26 via low melt solder 36 (FIG. 6A). The purpose of the low melt connection is to prevent a thief from opening lock 20 by merely heating lock 20. In the event nitinol lock 20 is heated, low melt solder 36 will melt, causing crimps 35 to move downward. Nitinol wire 23 will contract due to the heat, however because crimps 35 have lowered there will not be enough force to move driver arm 29 (FIG. 6B).

As shown in FIGS. 1A and 1B, driver arm 29 is pivotally connected to driver arm support bracket 43 via pivot axis 44. Before power is supplied to nitinol wire 23, jam plate 48 covers locking pin 11 and blocks upward movement of locking pin 11 (FIGS. 1A and 1C). After power is directed to nitinol wire 23, nitinol wire 23 contracts causing driver arm 29 to pivot clockwise (FIG. 1B). Jam plate 48 is connected to PCB 26 via return spring 46. The clockwise pivoting of driver arm 29 causes jam plate 48 to move rightward so that locking pin 11 is no longer blocked by jam plate 48 (FIGS. 1B and 1D).

Once jam plate 48 is no longer covering locking pin 11, the user is able to turn key 30. The turning of key 30 causes lower inner body 12 to also turn (FIGS. 1E-1G). In FIG. 1E, locking pin 11 has made contact with edge 51 of indentation 25. In FIG. 1F, edge 51 is pushing locking pin 11 upwards and clear of indentation 25 and compressing spring 89. In FIG. 1G, lower inner body 12 has turned and locking pin 11 is clear of indentation 25. Locking spring 52 is compressed between locking pin 11 and lower inner body 12. Lock 20 is in an unlocked position in FIG. 1G.

Removing the Key and Re-Locking the Lock

To place lock 20 in the locked position the user turns key 30 (FIG. 5B) so that nodule 97 on key 30 is aligned with alignment indentation 98 on outer shell 1. The user is then able to remove key 30.

As the user turns key 30 from the unlocked position to the locked position, locking pin 11 moves from the position shown in FIG. 1G to the position shown in FIG. 1D. Spring 89 is compressed and therefore pushes locking pin 11 downward into indentation 25. When the locking pin is in the position shown in FIG. 1D, the user may remove key 30 from the lock. Power is then no longer supplied to nitinol wire 23. Therefore nitinol wire 23 will expand. Spring 46 is biased and will pull jam plate to the left (FIG. 1A) so that it covers locking pin 11 (FIGS. 1A and 1C). Lock 20 is now locked.

Driver Arm Moves Away from Lock Face

It should be noted that driver arm 29 rotates clockwise so that it moves jam plate 48 to the right and away from lock face 38 (FIG. 1B) to unlock lock 20. This is a security feature that prevents lock 20 from being shocked or impacted open if lock face 38 is struck suddenly by a thief.

Engagement Tabs

Figures 3A, 3B:
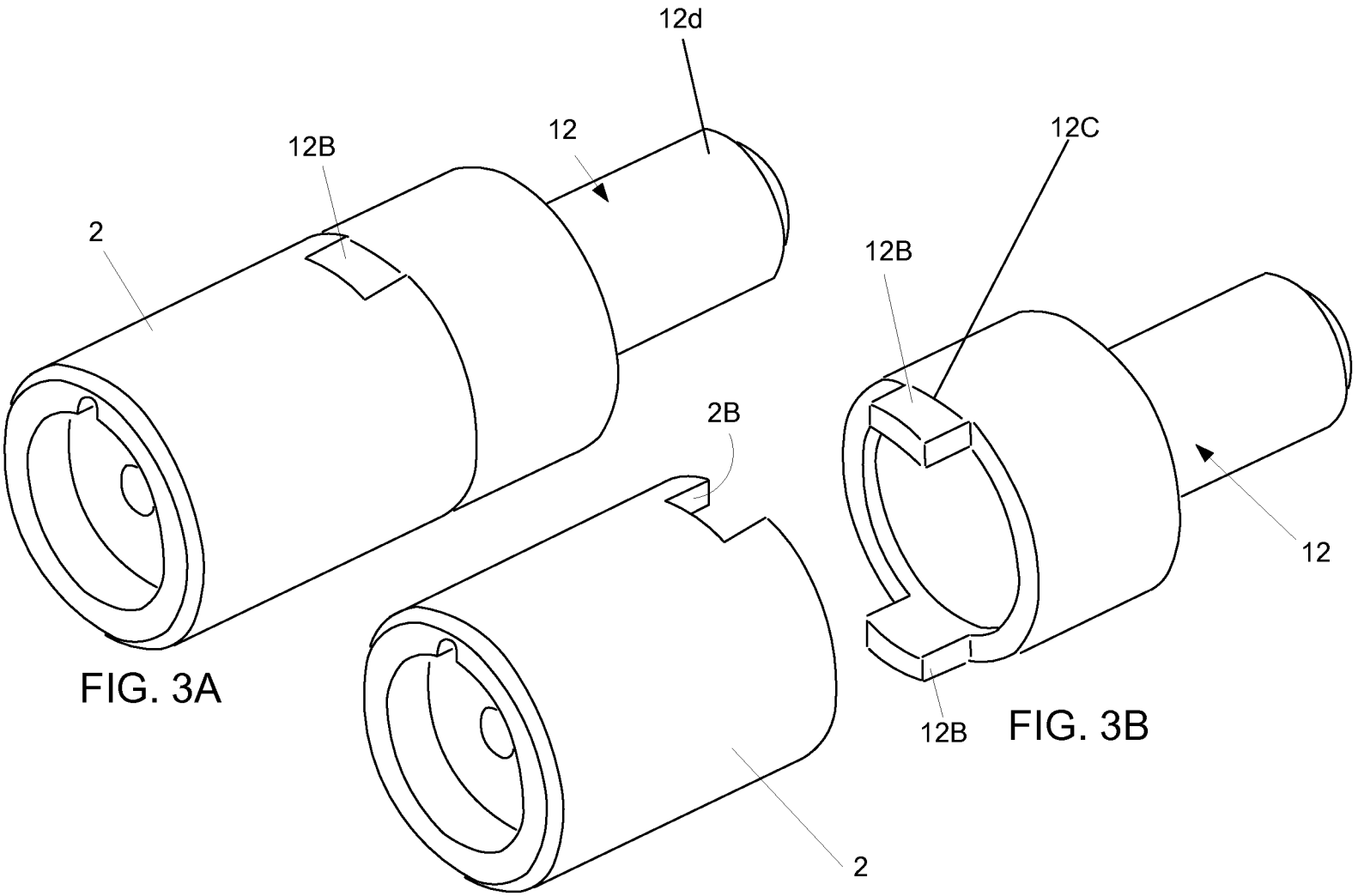
FIGS. 3A and 3B show a preferred inner body and lower inner body.

In a preferred embodiment tabs 12B engage with notches 2B to rigidly hold inner body 2 connected to lower inner body 12 (see also FIGS. 3A and 3B). If a thief tries to force open lock 20 by forcing the rotation of the key when the lock is in the locked position, tabs 12B will break along fracture line 12C leaving lock 20 in a secure position. Fracture line 12C is a weak connection between tabs 12B and lower inner body 12 allowing for the break.

Alternative Outer Shells for Key Removal

Figures 7A, 7B, 7C:
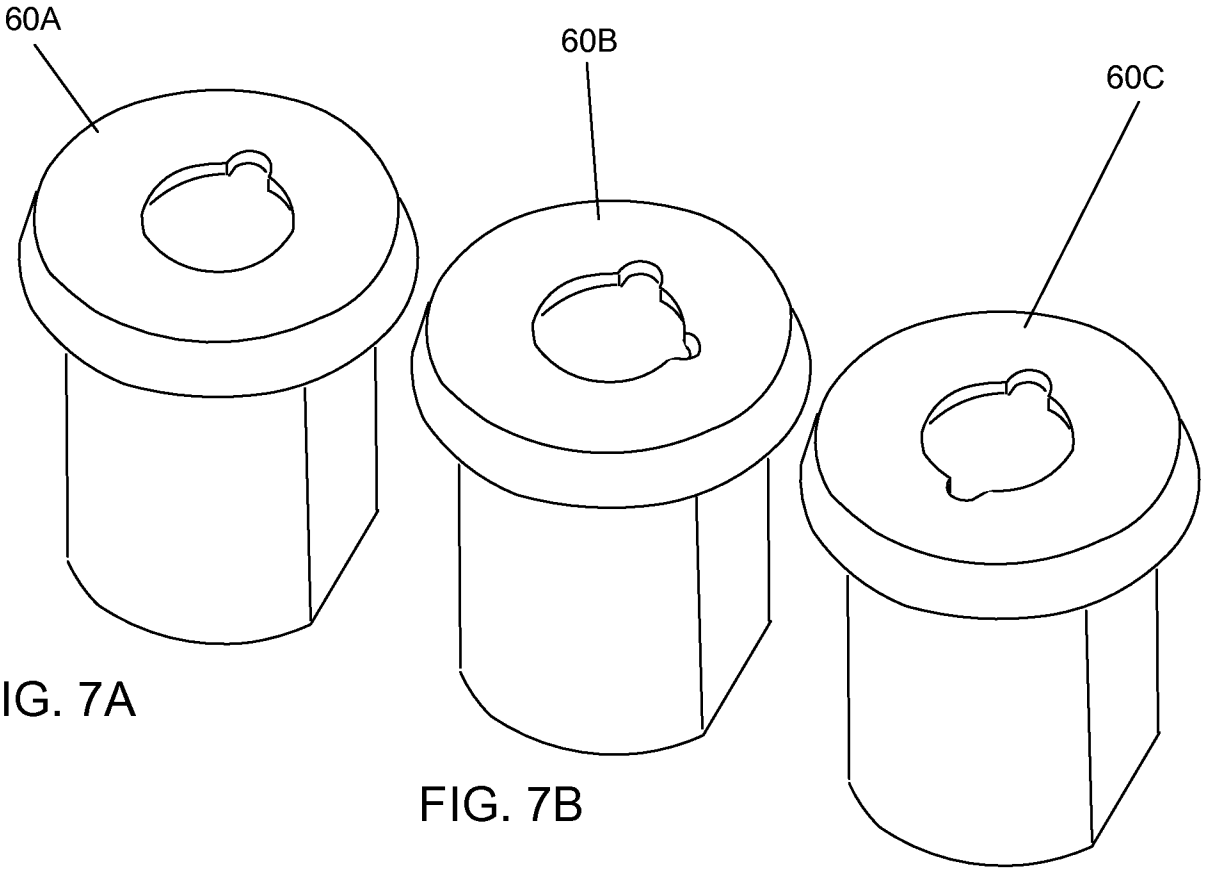
FIGS. 7A-7C show preferred outer shells.

FIGS. 7A-7C show alternative outer shells 60A-60C. It is also possible to alter the outer shell to accommodate so that key 30 can be removed from the shell at a variety of possible positions. For example, in FIG. 7A key 30 can be removed at the 12 o'clock position. In FIG. 7B, key 30 can be removed at either the 12 o'clock position or 3 o'clock position. In FIG. 7C, key 30 can be removed at either the 12 o'clock position or the 6 o'clock position.

Flexible Drive Arm

Figure 8:
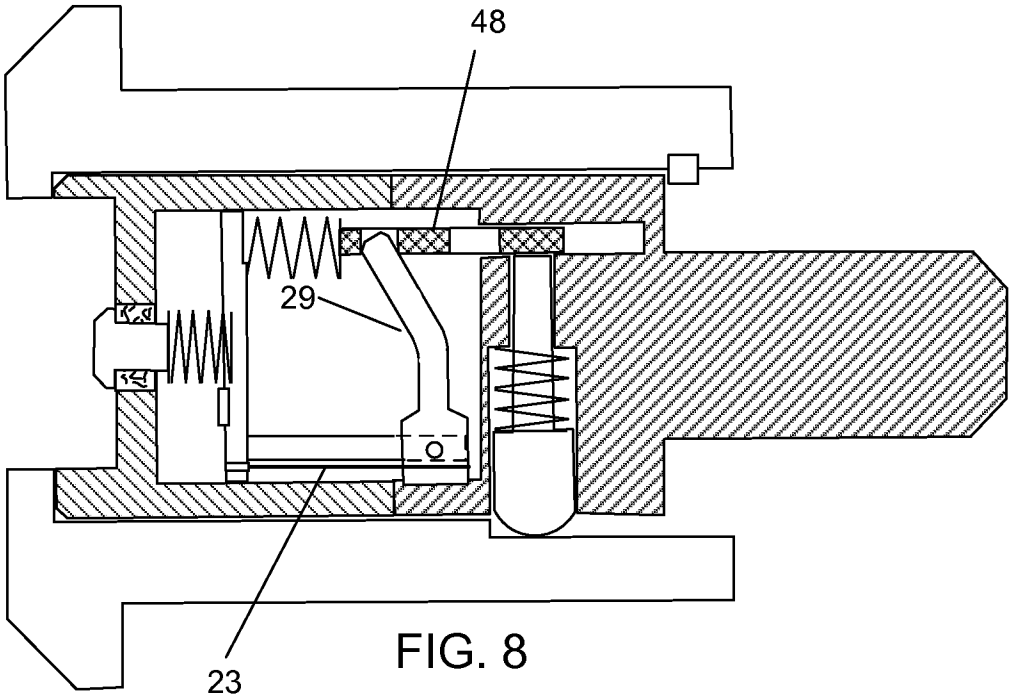
FIG. 8 shows a flexible driver arm.

It is also possible to utilize a flexible drive arm 29. This will prevent unwanted strain being applied to the wire. This will prevent breakage or stretching of nitinol wire 23 in the event jam plate 48 becomes stuck or jammed (see FIG. 8).

Alternative Electrical Actuators Embodiment

Figure 9A:
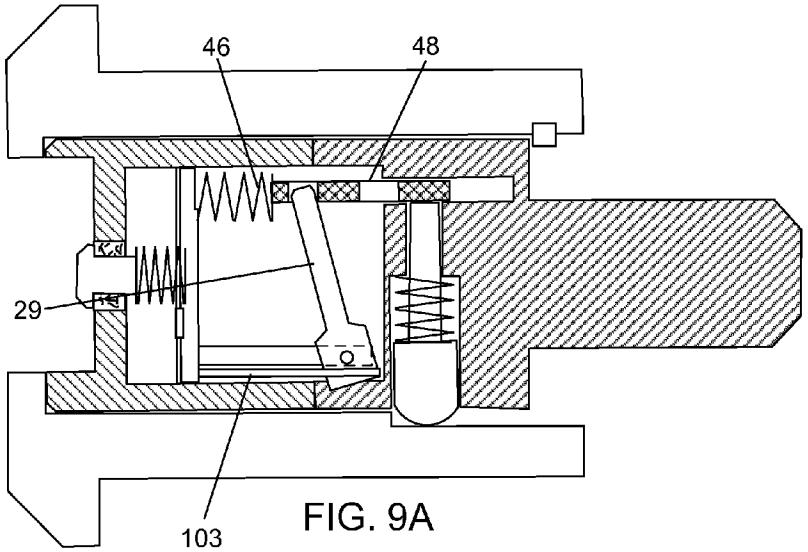
FIGS. 9A-9B show another preferred embodiment of the present invention.
Figure 9B:
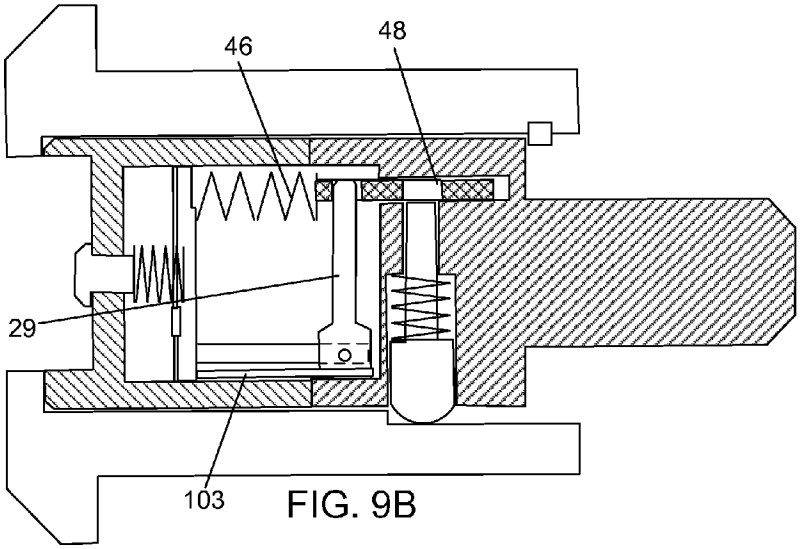

In another preferred embodiment rather than nitinol wire 23, electrical actuator 103 may be utilized to move jam plate 48 (FIGS. 9A and 9B). As the electrical actuator is actuated, jam plate 48 moves between the positions shown in FIGS. 9A and 9B. The lock functions in a fashion similar to that already described above. Electrical actuator 103 be any other form of electrical actuator to move drive arm 29. For example electrical actuator 103 may be a solenoid, a piezo linear actuator or other electrical motor.

Other Preferred Features

It should be noted that the inner assembly of lock 20 is very compact with few moving parts, and is very modular. Also in a preferred embodiment, as an additional security feature no magnetic parts are used for the internal mechanisms of lock 20. Prior art locks are usually affected by magnets. Also it should be noted that there is no power source in lock 20, rather the power is supplied by the key as it is inserted. This is preferable because there are therefore no requirements to recharge or change a power source in lock 20.

Although the above-preferred embodiments have been described with specificity, persons skilled in this art will recognize that many changes to the specific embodiments disclosed above could be made without departing from the spirit of the invention. Therefore, the attached claims and their legal equivalents should determine the scope of the invention.

What is claimed is:

1. An electrical mechanical locking device, comprising:

A. a lock, comprising:

i. an outer shell comprising an outer shell indentation and comprising a key alignment indentation, ii. an inner body rotatably housed within said outer shell and rotatably connected to said outer shell, said inner body comprising a lock face and comprising a key nodule receptor adjacent to said key alignment indentation, iii. a contact pin connected to said inner body, iv. a printed circuit board frame rigidly connected to said inner body wherein said printed circuit board frame is parallel to said lock face, v. a printed circuit board connected to said printed circuit board frame wherein said printed circuit board is parallel to said lock face, vi. a driver arm support bracket rigidly connected to said printed circuit board frame, vii. a lock microprocessor connected to said printed circuit board and electrically connected to said contact pin, viii. a key identification code verification database in electrical connectivity with said lock microprocessor, ix. a nitinol wire electrically connected to said lock microprocessor, wherein said nitinol wire comprises two ends, each of said two ends connected to said printed circuit board and to said printed circuit board frame, x. a driver arm pivotally connected to said driver arm support bracket, wherein said nitinol wire is looped around said driver arm, xi. a jam plate connected to said driver arm, xii. a jam plate return spring connected to said jam plate and said printed circuit board frame, wherein said jam plate return spring expands and contracts in a direction perpendicular to said lock face, wherein said driver arm and said jam plate return spring move said jam plate in a direction perpendicular to the lock face, and xiii. a locking pin, wherein said locking pin is covered by said jam plate and inserted into said outer shell indentation when said electrical mechanical device is locked and wherein said locking pin is not covered by said jam plate and is clear of said outer shell indentation when said electrical mechanical device is unlocked, xiv. a locking pin return spring, B. a key, comprising:

i. a key microprocessor, ii. a power source electrically connected to said key microprocessor, iii. a database electrically connected to said key microprocessor, said database comprising a key identification code for identifying said key, and iv. a contact tip electrically connected to said key microprocessor, said contact tip for insertion into said lock, v. a key nodule for engaging said key nodule receptor, wherein when power from said power source is applied to said nitinol wire, said nitinol wire will contract causing said driver arm to pivot about said driver arm support bracket, which will cause said driver arm to push said jam plate away from said lock face, which will cause said jam plate to uncover said locking pin, which will allow a user to turn said key causing said key nodule engaged with said key nodule receptor to rotate said inner body causing said locking pin to move out of said outer shell indentation so that said lock can be moved from a locked position to an unlocked position, wherein when a user turns said key to move said lock from said unlocked position to said locked position said locking pin will be positioned over said outer shell indentation which permits said locking pin return spring to push said locking pin into said outer shell indentation, which permits a user to remove said key from said lock causing said power source to be removed from said nitinol wire causing said nitinol wire to expand allowing said jam plate return spring to pull said jam plate towards said lock face to cover said locking pin to lock said lock.

2. The electrical mechanical locking device as in claim 1, wherein said lock is unlocked by:

A. inserting said key into said lock,

B. transmitting said key identification code to said lock microprocessor,

C. verifying said key identification code at said key identification code verification database, D. transmitting an electrical signal from said lock microprocessor to said nitinol wire after said verification of said key identification code, E. contracting said nitinol wire, F. pulling said driver arm, G. uncovering said jam plate from said locking pin, H. turning said key, and I. clearing said locking pin from said outer shell indentation.

3. The electrical mechanical locking device as in claim 1, wherein said inner body comprises:

A. an upper inner body, and

B. a lower inner body rigidly connected to said upper inner body with breakaway tabs.

4. The electrical mechanical locking device as claim 1, wherein said nitinol wire is an electrical actuator.

5. The electrical mechanical locking device as in claim 1 further comprising:

A. nitinol wire crimps, wherein said nitinol wire is connected to said printed circuit board frame via said nitinol wire crimps, and B. low melt solder, wherein said nitinol wire crimps are mounted to said inner body via said low melt solder.

6. The electrical mechanical locking device as in claim 1 wherein said driver arm is flexible.

7. The electrical mechanical locking device as in claim 1, wherein said outer shell retains said key inside said locking device until said key nodule is aligned with said key alignment indentation.

* * * * *